United States Patent [19]

Rudell et al.

[11] Patent Number: 4,890,838

[45] Date of Patent: Jan. 2, 1990

[54] TIMED WATER RELEASE TOY

[75] Inventors: Elliot Rudell, 6556 Sattes Dr., Rancho Palos Verdes, Calif. 90274; George Foster, Signal Hill; Joseph Cernansky, Lomita, both of Calif.

[73] Assignee: Elliot Rudell, Rancho Palos Verdes, Calif.

[21] Appl. No.: 299,225

[22] Filed: Jan. 23, 1989

[51] Int. Cl.[4] ..... A63F 9/00

[52] U.S. Cl. ..... 273/138 R; 273/1 GE; 273/58 H

[58] Field of Search ..... 273/1 R, 1 G, 1 GE, 273/58 B, 58 BA, 58 H, 138 R

[56] References Cited

U.S. PATENT DOCUMENTS 3,176,430 4/1965 Ryan ..... 273/148 R
3,795,400 3/1974 Glass et al. ..... 273/1 R
4,783,074 11/1988 Kobayashi ..... 273/157 R
4,813,680 3/1989 Rudell et al. ..... 273/138 R

*Primary Examiner*—Anton O. Oechsle
*Attorney, Agent, or Firm*—Plante Strauss Vanderburgh

[57] ABSTRACT

There is disclosed a ball having a foraminous outer shell with an inner membrane which forms an interior closure within the outer shell and with a timer and a release mechanism operative to open the inner membrane and release its contents after the time on the timer expires. The contents spill through the foraminous outer shell, wetting the player who is handling or catching the ball at the moment of release. The timer is activated and the ball is used in a game in which it is tossed between participants who seek to avoid becoming wet when the timer releases the water from the interior closure of the ball.

30 Claims, 4 Drawing Sheets

FIG. 2
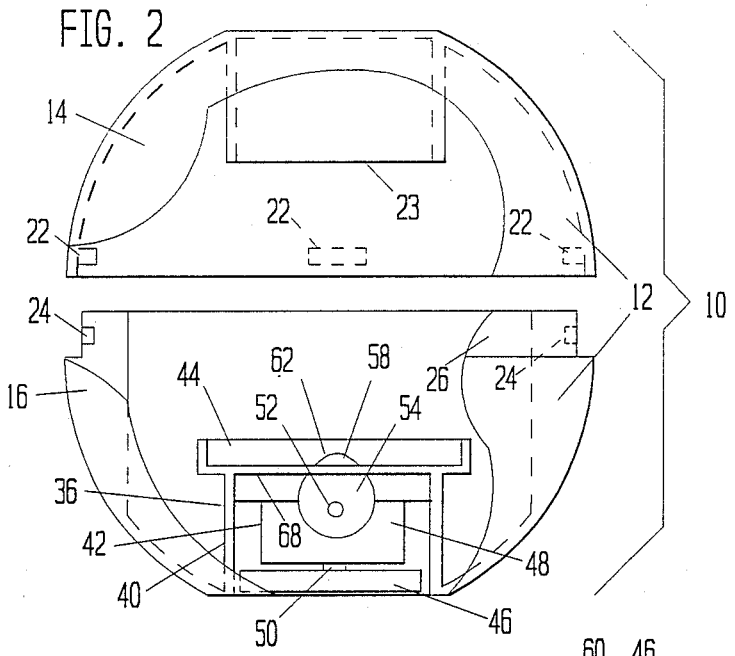
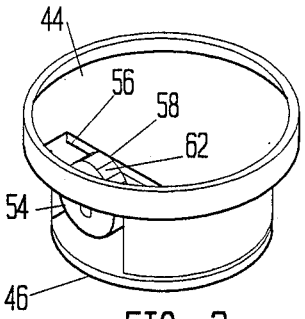
FIG. 3
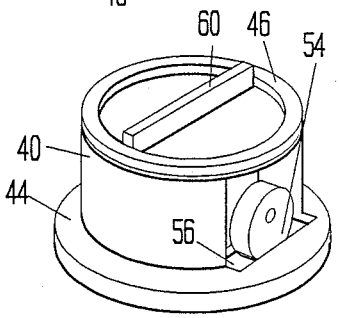
FIG. 4

FIG. 5
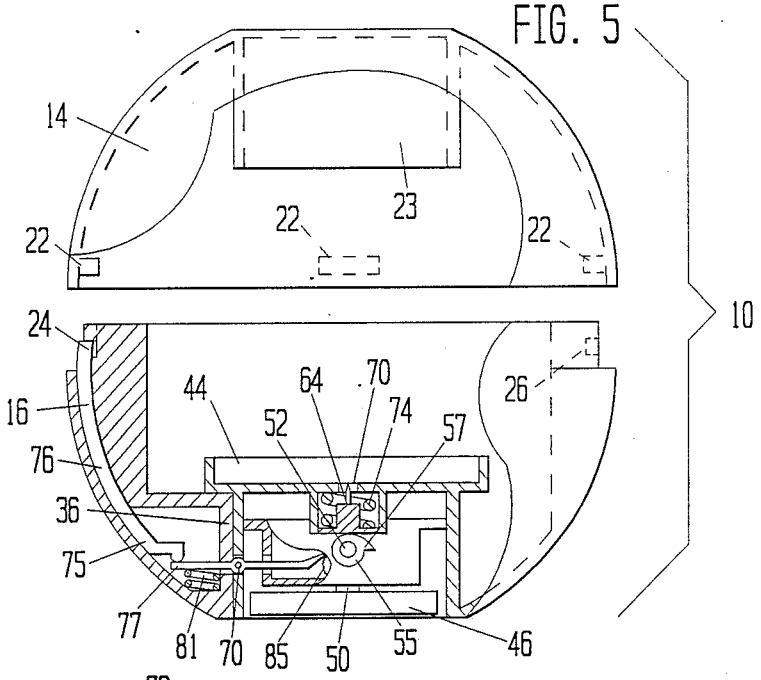
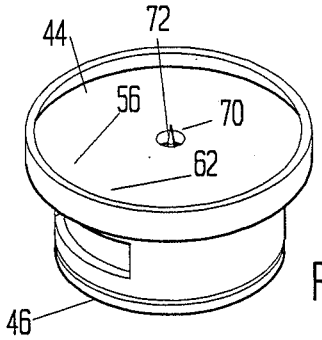
FIG. 6
FIG. 7
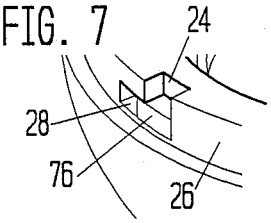

TIMED WATER RELEASE TOY

BACKGROUND OF THE INVENTION

1. Field of Invention

This invention relates to a ball and game, and in particular, to a ball with a timed water release mechanism and a game using the ball.

2. Brief Statement of the Prior Art

Several different activity toys involving water play resulting in wetting of the players are currently on the market. One in particular is marketed by Mattel Toys and is called WETHEAD. This product involves a hat-like device that a player wears and comprises a water container on a hat having a release valve permitting the water to empty onto the wearer's head. Only one of eight removable rods releases the water valve. The other seven placebo rods are identical and the player wearing the hat must select and remove a rod. This toy does not involve timing, tossing, or ball play. The water containing element is a hat which is not disposable and is refilled and reused during the play. Other water products that have been offered to children include sprinkler based toys, such as WATER WIGGLER, and WET BANANA. These toys attach to a garden hose and provide a constant flowing film of water on a surface which children run or slide through. These toys do not provide an element of surprise or challenge.

Parker Brothers, a game manufacturer, is currently marketing a product called HOT POTATO. This consists of a cloth covered foam "potato" that young children toss back and forth between each other. Inside the potato is an electronic sound generating device that signals the end of the play session. The player holding the potato at the end of the session must take a card spelling part of the toy's name. This product does not involve water, is not a ball, and provides no action "penalty" such as a soaking of the player.

BRIEF STATEMENT OF THE INVENTION

This invention comprises a ball having a foraminous outer shell with an inner membrane which forms an interior closure within the outer shell and with a timer and a release mechanism operative to open the inner membrane and release its contents after the time on the timer expires. The contents spill through the foraminous outer shell, wetting the player who is handling or catching the ball at the moment of release. For this purpose, the inner membrane forms an interior closure which is charged with water at commencement of play. The timer is activated and the ball is used in a game in which it is tossed between participants who seek to avoid becoming wet when the timer releases the water from the interior closure of the ball.

BRIEF DESCRIPTIONS OF THE DRAWINGS

The invention will be described with reference to the FIGURES of which:

FIG. 2 is an elevational view of the ball partially disassembled and in partial cross-section;

FIG. 3 is a perspective view of the timer and liquid release mechanism;

FIG. 4 is an inverted view of the timer and water release mechanism of the toy of FIG. 1;

FIG. 5 is an elevational view of an alternative toy of the invention partially disassembled and in partial cross-section;

FIG. 6 is a perspective view of the timer and water release mechanism of the toy of FIG. 5;

FIG. 7 is a perspective view of a safety interlock for the toy of FIG. 6;

DESCRIPTION OF PREFERRED EMBODIMENT

Figure 1:
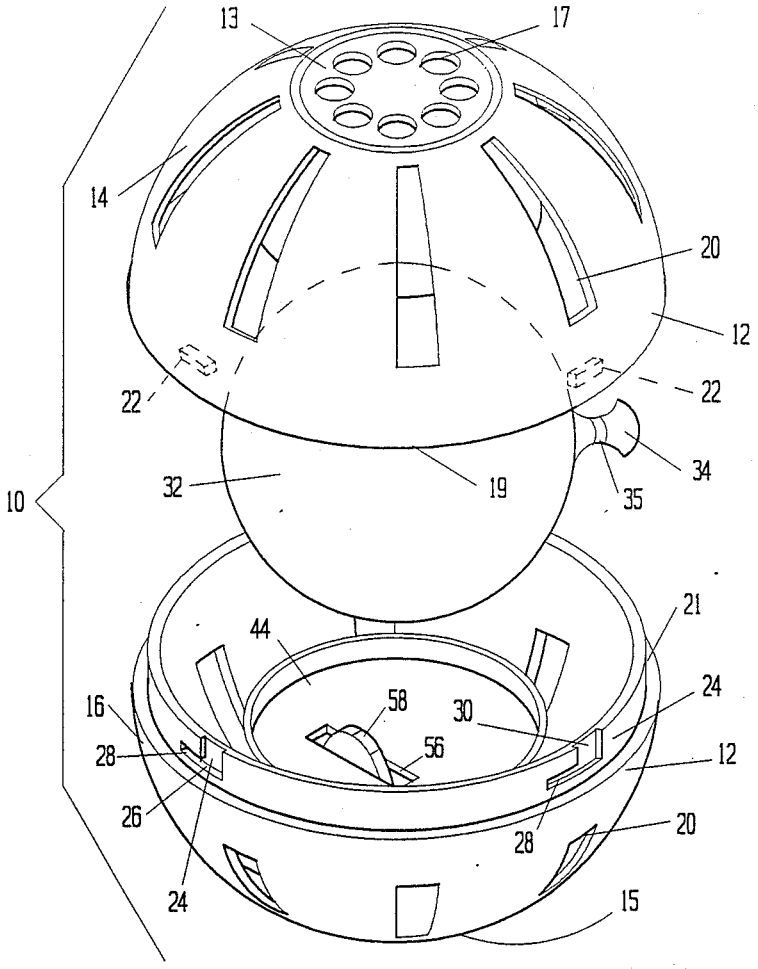
FIG. 1 is an exploded perspective view of the ball.

Referring now to FIG. 1, the invention comprises a ball 10 including an outer foraminous shell 12 that is preferably having two hemispherical half shells 14 and 16, each of which has a plurality of through apertures in the form of elongated slots 20 at equally spaced angular increments about their circumference. Opposite ends of 13 and 15 the assembled shell are flatted, and the flat of the upper hemispherical half shell 14 is perforated with a plurality of circular aperture 17. The two hemispherical half shells are received together at their circular bases 19 and 21 which are on the equator of the spherical ball 10. Suitable means are provided to retain the assembly of the two half shells 14 and 16. Various assembly means can be used, including threaded engagement or an interlocking slot and key engagement. The latter is preferred and is illustrated with one hemispherical half shell 14 bearing a plurality of raised keys 22 spaced about its inner wall which coact with mating offset grooves 24 that are spaced about the upstanding inner cylindrical wall 26 of the opposite hemispherical half shell 16. Each offset groove 24 has a long base slot 28 and a shorter entrance slot 30, thereby permitting an interlocking assembly and disassembly of the hemispherical half shells. Centrally disposed within the outer shell 12 formed by assembly of the hemispherical half shells is a balloon 32 formed of a thin membrane, preferably of plastic, and most preferably of an elastomer. An example of a suitable balloon is a rubber latex balloon. The balloon 32 forms an interior closure within the outer shell 12, and this enclosure has a port, open end 34, which can be used for filling the balloon and then can be sealed with a tie 35 in a customary manner. The balloon is filled with water in which a water soluble dye may have been dissolved.

Referring now to FIG. 2, there is shown an elevational sectional view of the ball. As previously mentioned, the two half shells 14 and !6 are aligned and assembled together at their bases and half shell 16 has a cylindrical wall 26 that is received within the other hemispherical half shell 14. The upper half shell 14 has a cylindrical inner wall 23 which presses against balloon 32 and stabilizes the balloon (see FIG. 1) within the assembled shell. Received within half shell 16 is a timer and release subassembly 36 which has a subassembly housing 40 forming an interior chamber 42 which is covered by a support platform 44 which faces inwardly of the assembled outer shell 12. The platform 44 serves to support the balloon 32. Received within the housing of the timer and release mechanism is a spring-driven motor 48, which has a winding shaft 50 with a key, disc 46, to wind the spring of the motor. The drive motor 48 has an output shaft 52 which extends from the subassembly housing 40 and which supports cam 54 which has a single lobe 58.

The timer and release mechanism is also illustrated in FIGS. 3 and 4. As shown in FIG. 3, the platform 44 has an aperture 56, in the form of a slot which receives cam 54 so that the single lobe 58 of the cam extends through the slot as the cam is rotated.

Referring now FIG. 4, the motor and release subassembly is inverted from its position in FIG. 3, showing the circular winding disc 46 which preferably has a single raised rib 60 which aids gripping of the disc 46.

As apparent from FIG. 3, the cam is mounted adjacent the slot 56 so that its single lobe 58 will extend through the slot 56 and above the platform 44. The release means is a membrane rupturing member which comprises an abrasive layer 62 on the lobe 58 of the cam 54. Suitable abrasive layers include coatings of abrasives, e.g., a coating of sandpaper or alumina grit. As the cam is rotated, this abrasive layer 62 will rub against the membrane of balloon 32, tearing the membrane and thus rupturing the balloon to release its contents.

Referring now to FIG. 5, there is illustrated an alternative embodiment of the invention. The outer shell 10 and the inner membrane container (not shown), are the same as previously described with reference to FIGS. 1 and 2. The timer and release mechanism 36 are also contained in a subassembly housing 40 and the motor 48 has a winding disc 46, all as previously described. In this embodiment, however, the release mechanism includes a pin member 64 which is slidably received in a cylindrical well 66 which depends from the underside 68 of the platform 44. The platform 44 has a single central aperture 70 (see FIG. 6) through which the pin 72 of the pin member 64 can extend. The pin member 64 rides on the surface of the cam 55 and is biased against the cam 55 by a coil spring 74 which is received over the pin member 64. The pin member 64 is thus biased into a retracted position and is moved into its extended position shown in FIG. 6 by the cam 55 with its single lobe 57.

Preferably a safety interlock is provided to prevent the pin 72 from extending through the aperture 70 when the two hemispherical half shells are disassembled. As shown in FIGS. 5 and 7, a slide member 76 is positioned in the base slot 28 of one of the grooves 24 so that it is forced downwardly when the mating key 22 of the other half shell enters the base slot. The lower end 75 of the slide member 76 rests on lever 77 which is pivotally mounted by pin 70, and is spring biased against the downward movement of slide member 76 by a compression spring 81. The opposite end of lever 77 extends through a window 83 in the side wall of the motor housing and engages a drive gear 85 of the motor, thus locking the motor and cam 55 against rotation. When the two halves of the outer shell 10 are assembled, slide member 76 depresses lever 77 and releases gear 85, permitting rotation of cam 55.

Figure 8:
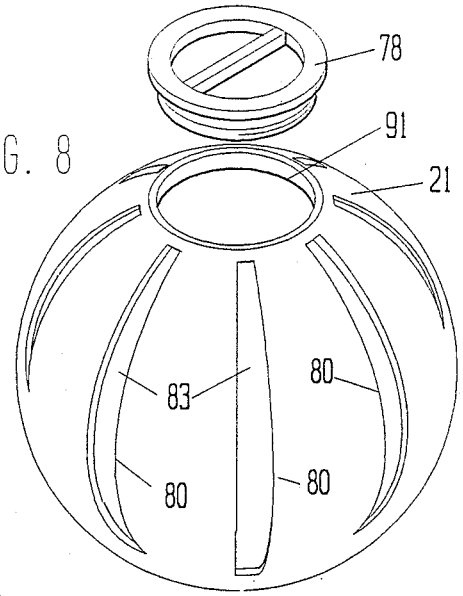
FIG. 8 is a perspective view of an alternative toy of the invention.
Figure 9:
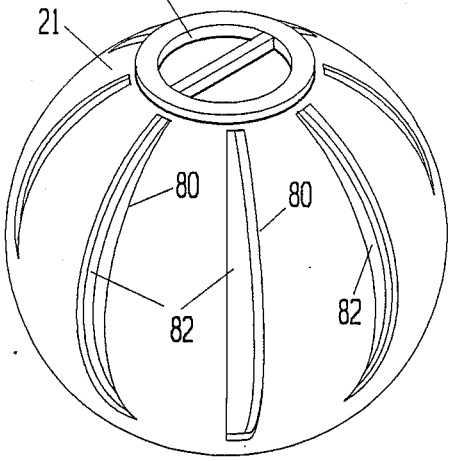
FIG. 9 is a perspective view of the assembled toy of FIG. 8.
Figure 10:
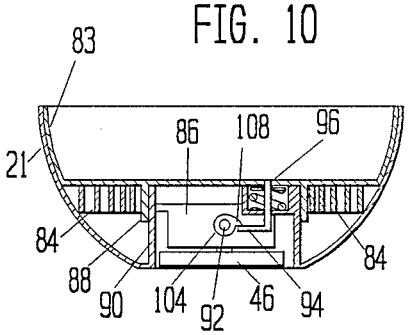
FIG. 10 is an elevational sectional view of the timer and water release mechanism of the toy of FIGS. 8 and 9.

Referring now to FIGS. 8–10, there is illustrated an alternative embodiment. In this embodiment, the outer shell 21 is a single piece member having a port 91 at one end that receives a closure member 78. The shell 21 is foraminous and has a plurality of slots 80 spaced about its circumference. Rotatably received within the outer shell 21 is a second inner spherical member 83 which also has a plurality of slots 82 (see FIG. 9) which can be rotated between a closed position with its wall between slots 82 closing the slots 80 of the outer member as shown in FIG. 8, and an opened position in which its slots are rotated into alignment with the slots of the outer shell, as shown in FIG. 9.

As shown in FIG. 10, the inner member 83 has a cylindrical base 88 at one end which is received about a cylindrical well 90 of the outer shell 21, thereby providing a trunnion that rotationally supports the inner member 83. Preferably, the inner member 83 is spring biased into the position where its slots 82 are aligned with the slots 80 of the outer shell 11 As shown in FIG. 10 this bias can be provided by a helical coil spring 84 which is mounted about the cylindrical base 88 of the inner member and is secured to the outer spherical shell 21.

A timer mechanism 86, which is substantially the same as that previously described is received within the cylindrical well 90 of the outer shell 21. This timer mechanism 86 has an output shaft 92 on which is mounted a cam 104 having a single lobe 108. The lobe 108 of the cam 104 engages a hook shaped latch member 94 that protrudes through the upper wall of the housing and into a single aligned recess 96 in the bottom wall 98 of the inner member 83. This recess extends partially into, but not through the bottom wall.

In this embodiment, the inner member 83 is rotated into a closed position shown in FIG. 8 and the latch member 94 is engaged in the recess 96 in the undersurface of bottom wall of the inner member. The interior of the inner member can then be filled with water and the closure 78 is placed on the inner member and threaded into the upper neck of the inner member. As previously mentioned, the outer member receives the closure and has a sufficiently large aperture to permit the closure to be rotated within the outer shell.

The toy ball is used in the same manner as those previously described. The spring drive of the motor is wound and the motor is released to begin the rotation of the cam, thereby commencing the timed release of the contents of the ball. When the cam rotates into engagement with the latch member and retracts the latch member from its detenting position in the recess, the inner member is released and, under the tension of the spring, will rotate into the water releasing position shown in FIG. 9.

The game comprises two or more participants, preferably several, to play catch with the toy ball. The objective of the game is to avoid getting wet when the timing mechanism releases the inner chamber and ruptures the inner chamber to release the water. As the timer winds down the ball is thrown between players who must catch the ball to avoid being disqualified. When a player catches the ball or is holding the ball and the inner member is ruptured, the water will discharge, wetting the player who is then disqualified from the game.

The invention has been described with reference to the illustrated and presently preferred embodiment. It is not intended that the invention be unduly limited by this disclosure of the presently preferred embodiment. Instead, it is intended that the invention be defined, by the means, and their obvious equivalents, set forth in the following claims:

What is claimed is:

1. A ball comprising:

a. an outer foraminous shell;

b. an inner membrane member supported by said outer shell and forming a sealed enclosure therein;

c. sealable port means in said inner membrane to permit filling of said sealed enclosure with an aqueous medium;

d. timer means fixedly received within said outer foraminous shell; and e. aqueous medium release means also received within said outer foraminous shell and responsive to said timer to open said sealed enclosure and permit discharge of its contents through said foraminous shell.

2. The ball of claim 1 wherein said inner membrane is a balloon formed of a flexible plastic.

3. The ball of claim 2 wherein said flexible plastic is an elastomer.

4. The ball of claim 2 which is spherical in external shape.

5. The ball of claim 1 wherein said outer shell is an assembly of two shell members with retention means to permit their removable assembly.

6. The ball of claim 5 wherein said outer shell is an assembly of two hemispherical halves with said retention means at their mating edges.

7. The ball of claim 6 wherein said retention means comprises pin and mating groove means carried on respective ones of said two hemispherical halves.

8. The ball of claim 1 wherein said timer means includes a motor.

9. The ball of claim 8 wherein said motor is a spring driven motor with key means to wind the spring.

10. The ball of claim 1 wherein said timer means includes a cam member rotatably driven by said motor.

11. The ball of claim 2 wherein said timer means includes a cam member rotatably driven by said motor and said release means includes a balloon rupturing member positioned adjacent said cam and moveable by said cam into a position to rupture said balloon.

12. The ball of claim 11 wherein said rupturing member is a pin member mounted between said cam and said balloon and slidable between a retracted position and an extended, balloon-rupturing position.

13. The ball of claim 12 wherein said release means includes a housing and said pin member comprises a piston slidably mounted in said housing and supporting a distal pin and including a spring mounted about said piston to bias said pin member into its retracted position.

14. The ball of claim 11 wherein said rupturing member is a coating of an abrasive material on the lobe of said cam.

15. The ball of claim 4 wherein said timer and release means are a subassembly removably mounted within said outer shell.

16. The ball of claim 15 wherein said subassembly includes a subassembly housing having an interior chamber which receives said timer.

17. The ball of claim 16 wherein said subassembly housing has a platform facing the interior of said outer shell and said balloon rests on said platform.

18. The ball of claim 17 wherein said platform has an aperture which receives said rupture means.

19. The ball of claim 17 wherein said timer means includes a spring driven motor received within said interior chamber of said subassembly housing, with key means on an external wall of said subassembly housing to wind the spring.

20. The ball of claim 19 wherein said timer means includes a cam member rotatably driven by said motor and said release means includes a balloon rupturing member mounted in said aperture in said platform and moveable by said cam into a position to rupture said balloon.

21. The ball of claim 20 wherein said rupturing member is a pin member mounted between said cam and said balloon and slidable between a retracted position and an extended, balloon-rupturing position.

22. The ball of claim 12 wherein said release means includes a housing and said pin member comprises a piston slidably mounted in said housing and supporting a distal pin and including a spring mounted about said piston to bias said pin member into its retracted position.

23. The ball of claim 20 wherein said cam member is mounted within said aperture in said platform and having a lobe which extends above said platform as said cam is rotated, and wherein said rupturing member is a coating of an abrasive material on the lobe of said cam.

24. The ball of claim wherein said membrane comprises an inner foraminous member rotatably mounted within said outer shell and both said inner member and outer shell have through slots open in aligned positions and close in non-aligned positions as said inner member is rotated.

25. The ball of claim 24 including spring means biasing said inner member into a position with its slots aligned with the through slots of said outer shell, and including latch means to retain said inner member in its non-aligned position, against the bias of said spring means.

26. The ball of claim 25 wherein said timer means includes a motor and a cam member rotatably driven by said motor and mounted adjacent said latch means in a position in which its lobe engages and moves said latch member into a releasing position.

27. A game in which the ball of claim 1 is loaded with water within said inner membrane and said timer means is set to a random time to actuate said release means and the players throw the ball to each other with the objective of avoiding catching or holding the ball when said release means is actuated.

28. The game of claim 27 in which a player is disqualified and must withdraw from the play when the ball releases water onto the player.

29. The game of claim 28 wherein a player is disqualified when the player fails to catch the ball.

30. The game of claim 27 in which a water soluble dye is dissolved in the water.

* * * * *

UNITED STATES PATENT AND TRADEMARK OFFICE

CERTIFICATE OF CORRECTION

PATENT NO. : 4,890,838

DATED : January 2, 1990

INVENTOR(S) : Elliot Rudell et al

It is certified that error appears in the above—identified patent and that said Letters Patent is hereby corrected as shown below:

In the claims:

Claim 24, column 6, line 32, after "claim"insert --1--.

Signed and Sealed this

Twenty-fourth Day of October, 1995

*Attest:*

Bruce Lehman

BRUCE LEHMAN

*Attesting Officer*

*Commissioner of Patents and Trademarks*